United States Patent [19]

Rutter

[11] 3,946,868

[45] Mar. 30, 1976

[54] PACKAGE CONTAINING A STACK OF FLEXIBLE SHEET MATERIAL

[75] Inventor: Peter William Rutter, Ilford, England

[73] Assignee: Ilford Limited, United Kingdom

[22] Filed: Oct. 29, 1974

[21] Appl. No.: 518,931

Related U.S. Application Data

[63] Continuation-in-part of Ser. No. 255,480, May 22, 1972, abandoned.

[30] Foreign Application Priority Data

June 1, 1971 United Kingdom ..... 18294/71

[52] U.S. Cl. ..... 206/455; 206/453; 217/54; 229/14 C

[51] Int. Cl.[2] ..... B65D 25/12; B65D 85/48

[58] Field of Search ..... 206/449, 453, 454–456, 206/521; 217/52–54; 220/15; 229/14 C, 14 H

[56] References Cited

UNITED STATES PATENTS

| | | | |
|---|---|---|---|
| 1,821,692 | 9/1931 | Copeland | 229/14 C |
| 1,998,515 | 4/1935 | Miller | 206/453 |
| 2,762,678 | 9/1956 | Moore | 217/54 X |
| 2,885,139 | 5/1959 | Werner et al. | 206/453 |
| 2,984,399 | 5/1961 | Gaulke | 217/53 UX |
| 3,049,260 | 8/1962 | Stone | 217/53 |
| 3,344,916 | 10/1967 | Brueckner | 229/14 C X |
| 3,777,884 | 12/1973 | Hedin | 206/455 |

*Primary Examiner*—William Price
*Assistant Examiner*—Steven E. Lipman
*Attorney, Agent, or Firm*—Wenderoth, Lind & Ponack

[57] ABSTRACT

The present invention relates to a package comprising a stack of flexible light-sensitive sheet material. Four corner pieces of a strong material embrace the short side edges of the stack, the pack is placed in a rigid box, and spring means are provided in the closed box for urging each corner piece towards the diagonally opposite corner piece on the stack of sheet material.

6 Claims, 4 Drawing Figures

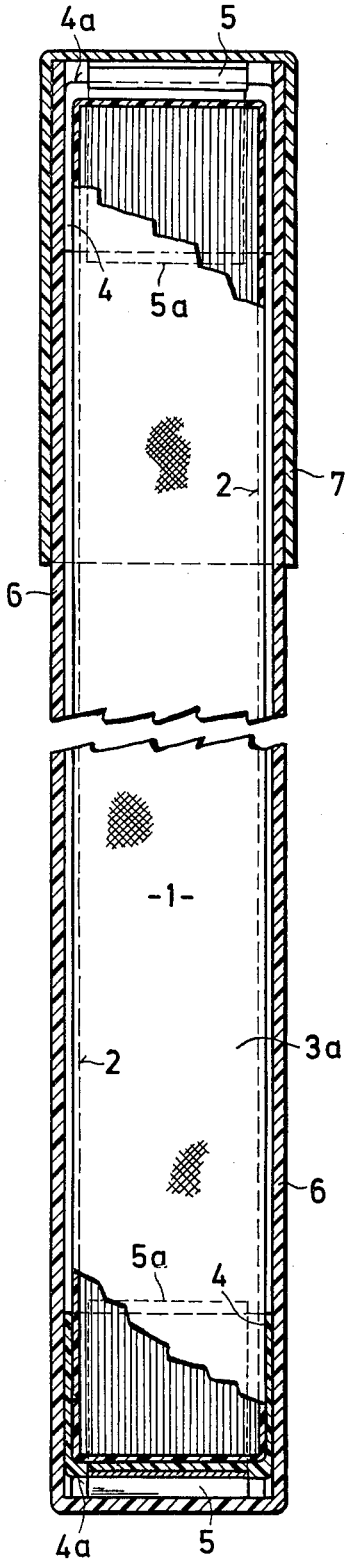
Fig. 2
Fig. 3
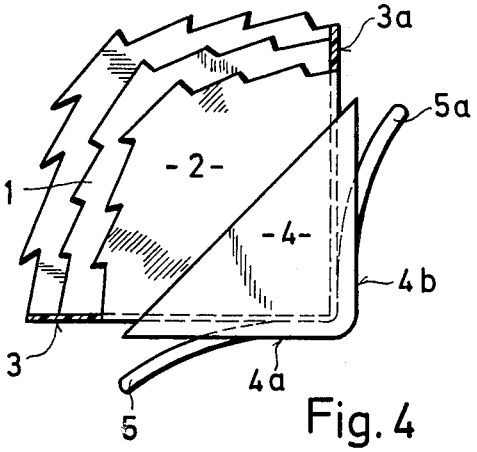
Fig. 4
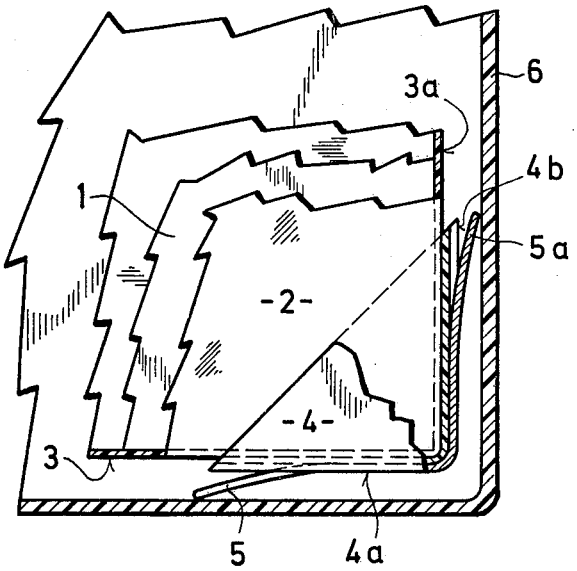

PACKAGE CONTAINING A STACK OF FLEXIBLE SHEET MATERIAL

This patent application is a continuation-in-part of my application Ser. No. 255,480 filed on May 22, 1972, now abandoned.

BACKGROUND OF THE INVENTION

This invention relates to a package comprising a stack of flexible light-sensitive sheet material.

It is difficult to pack stacks of sheets of light-sensitive material such as sheets of X-ray film material to ensure that during transportation of the stack there is no movement of the sheets relative to each other. Such relative movement cause scratching or marking of the surfaces of the sheet material if any particulate material such as dust is entrapped between the sheets of the stack. Such surface scratching or marking effects the light-senstive emulsion, which is on the surface of the sheet and alters its sensitometric properties in such a way that, depending on the conditions, either a sensitised or desensitised spot is produced, resulting in either a black or a white spot on development of the material. As it is almost impossible to exclude dust completely from the atmosphere when packing sheet material, it is very important to lessen the scratching effect of entrapped dust particles by preventing the relative movement of the sheets in a stack. A relative movement of as little as one hundreth of an inch (one fourth of a millimeter) can cause each entrapped dust particle to produce a very noticeable black or white spot on the developed material.

In U.S. Pat. No. 3,720,035 there is described a method of packing a stack composed of a plurality of flexible sheets which comprises stacking the flexible sheets to form a stack having two opposed face surfaces and two pairs of opposed side surfaces which define the thickness of the stack, one side surface of each pair being adjacent to both side surfaces of the other pair, the face surfaces and side surfaces of the stack forming edges which terminate in four corners where the two face surfaces are joined by two adjacent side surfaces, positioning four corner pieces made of a strong material so as to embrace each of the four corners of the stack of flexible sheets over the full thickness of the stack and thus encircling a portion of each face surface and the adjacent side surfaces which make up each corner to form a snug fit thereon, placing a length of strapping material around the side surfaces of the thus formed pack so that the strapping material passes around each of the positioned corner pieces, placing the pack into a rigid box or box-like structure, the dimensions of which are so chosen that the pack fits snugly in the box or box-like structure, thereafter applying a tension to the length of strapping material so causing the corner pieces to pull into close contact with the stack of flexible sheets, and then joining the length of strapping material to form a tension band around the pack. The stack of flexible sheets can be a stack of light-sensitive material.

The stack of flexible sheet material has preferably superimposed on each of its two large faces a sheet of stiff cardboard of the like rigid material, of slightly smaller dimension than the stack of flexible sheet material.

The length of strapping material under tension thus prevents the individual sheets from moving relatively to each other, and the stack of sheet material can not buckle due to the presence of the rigid box-like structure around the pack.

SUMMARY OF THE INVENTION

It is an object of the present invention to provide a package comprising a stack of flexible sheet material of the type described above, but wherein the use of a length of strapping material is no longer required.

This object and others which will become apparent hereinafter are attained, according to the invention, by providing a package comprising a stack of easily scratchable flexible sheets of light sensitive material;

a light-tight folder enclosing the stack;

a rigid box open at one end thereof and a lid adapted for covering the open end of the box, the box being so dimensioned as to enclose the stack so tightly that the latter is prevented from buckling;

four corner pieces, each of which is constructed of strong material and embraces one of the four small vertical edges of the stack at right angles to the plane of the sheets forming the stack and extends to embrace the corner portions of the two large side faces of the stack to form a tight fit thereon, each of the corner pieces being so dimensioned as to permit the side walls of the box to lie tightly against the light-tight folder enclosing the stack of easily scratchable flexible sheets, thereby preventing movement of the sheets in the stack relative to one another; and spring means engaging each of the corner pieces at the outside thereof and urging each of them toward a diagonally opposite corner piece.

Corner pieces to be placed on the four corners of a stack of sheet material, and extending to embrace not only the small vertical edges of the stack but also the corner portions of the two large side faces thereof have been known, e.g. from U.S. Pat. Nos. 1,998,515 and 3,618,755, in the packaging of glass sheets, while spring means placed in the four corners of a case or box or the like have been know even longer, e.g. form U.S. Pat. No. 1,821,692, for the purpose of enclosing fragile goods in a container in such a manner that, for instance, during shipping, the goods do not come into harsh contact with any solid surface but will be hung in the container in such a way that they will be cushioned in all directions.

In the package of the present invention, there is employed a novel combination of the above-described known corner pieces and the known spring means, in conjunction with a tight-fitting box, for the purpose of preventing buckling of a stack of flexible, light-sensitive sheets liable to be scratched and thereby seriously damaged, and at the same time preventing any relative movement of the individual sheets in the stack.

It is a particular advantage of the package according to this invention over the package described in U.S. Pat. No 3,720,023 that it does not require the use of a strap to hold the stack together. Also, the stiffening cover sheets which are indispensable in the last-mentioned known package, are not required in the package according to the invention.

The spring means for urging each corner piece toward a diagonally opposite corner piece when the box is closed may be for example moulded plastic integral springs secured in each corner of the box, including the corners formed when the lid is closed.

The spring means for two adjacent corner pieces are located in the two inner corners in the box, and the spring means engaging the other two corner pieces are located in the two inner corners of the lid.

It is not essential that the spring means employed be secured either to the box or to the corner pieces, but it is preferred that the spring means be secured to either one or the other.

Preferably the spring means are leaf springs for ease of manufacture and cheapness but they may be coil springs. In either case the springs are so mounted that when the stack is inserted into the box and the box is tightly closed the springs urge each of the corner pieces toward the diagonally opposite corner piece.

It is another essential feature of the present invention that the dimensions of the box are so chosen that when the stack together with the spring means is inserted therein the stack and the spring means are of a tight fit in the box. This tight fit is important over all the six faces of the box, and this means that the thickness of those parts of the corner pieces which rest on the corner portions of the large side faces of the stack are sufficiently thin so as to allow practically no play between the two large sidewalls of the box and the light-tight wrapping of the stack coming into contact therewith, thus effectively preventing any buckling of the sheets of the stack in the box.

By rigid material from which the box and lid may be made is meant material which can not easily bend, for example wood, plastics material or thick cardboard.

By corner pieces of relatively strong material is meant a material which will withstand a constant tension without distortion, for example metals such as copper, steel or aluminium, wood or plastics material such as high impact strength polystyrene or polypropylene may be used.

The corner pieces are so shaped that each of them fits over and embraces a corner of the stack of sheets of light-sensitive material enclosed in the light-tight folder. They may be of any size as long as all four can be fitted on to the stack, but preferably, because it is envisaged that these pieces will be non-returnable and thus must be cheap to produce, they embrace only small corner portions of the stack. The thickness of the stack of sheets of light-sensitive material must be such that the corner pieces fit tightly over each corner.

As the light-tight folder or wrapping there is preferably used a black-pigmented polyethylene bag.

BRIEF DESCRIPTION OF THE DRAWING

The accompanying drawings illustrate a preferred embodiment of the package according to the invention, and parts thereof.

FIG. 2 shows a cross-sectional view of the package taken in a plane indicated by II — II in FIG. 1.

FIG. 3 is a diagrammatic front elevation of a corner piece bearing two lateral springs fitted on to a stack of resilient sheet material enclosed in a light-tight polythylene bag.

FIG. 4 is a diagrammatic cross-sectional view of the corner piece of FIG. 3 in a corner of the closed box.

DETAILED DESCRIPTION OF THE INVENTION

Figure 1:
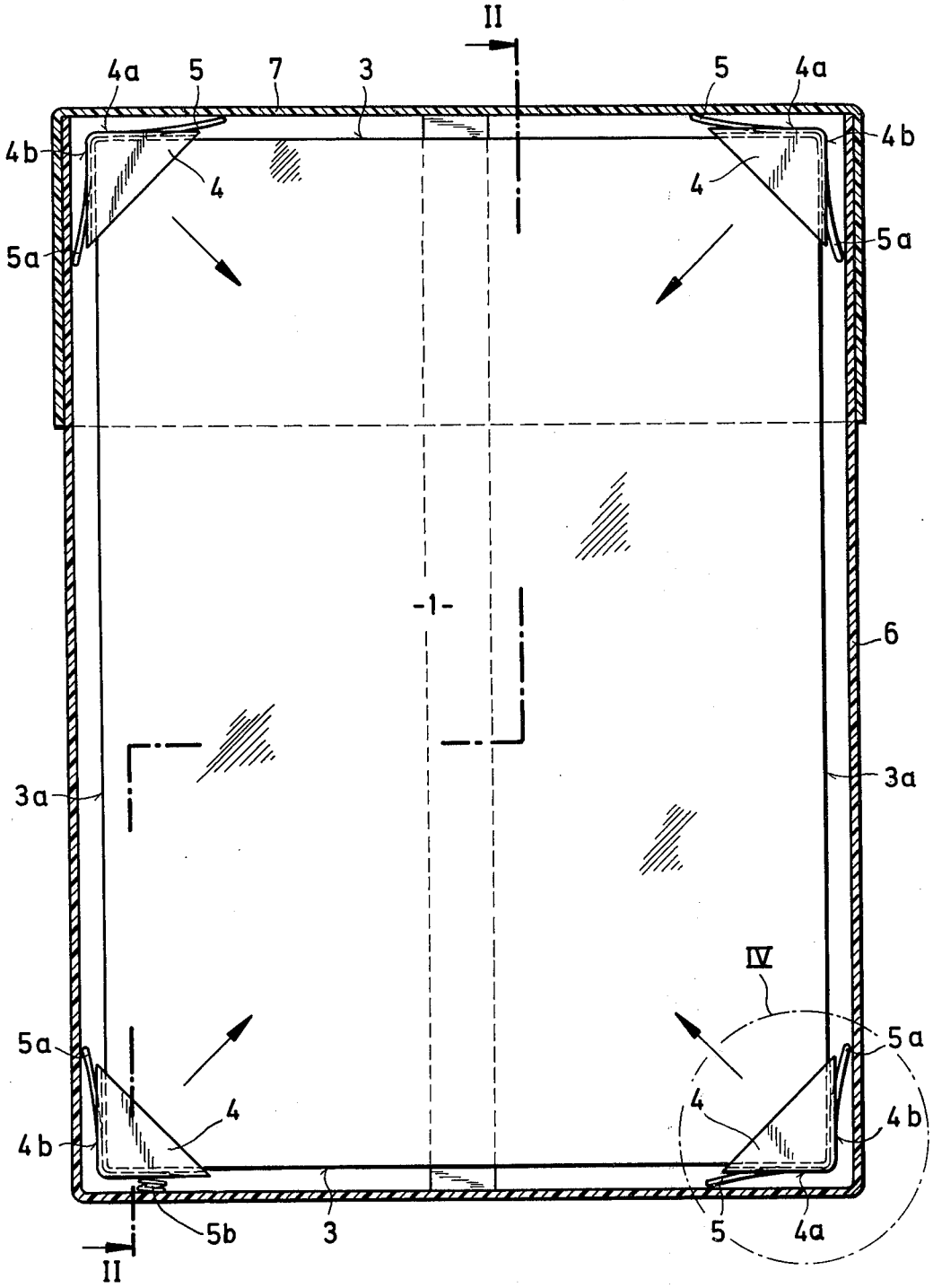
FIG. 1 is a diagrammatic cross-sectional view of a complete package having four corner pieces each of which bear two lateral springs in a closed box.

In FIGS. 1 to 4 like numbers refer to the same parts. In these figures a stack 1 of resilient light-sensitive sheet material enclosed in a light-tight polyethylene bag 2 is embraced at each vertical corner by a corner piece 4. Each corner piece 4 extends partially along two narrow side faces 3, 3*a* of the stack. Attached to the two sides 4*a* and 4*b* of each corner piece 4 are resilient parts in the form of lateral springs 5 and 5*a*. While blade springs are shown, they can be replaced by coil springs, as shown by 5*b* in the lower left corner of FIG. 1, or by spring means shown in U.S. Pat. Nos. 1,821,692, 2,984,399 or 3,344,916.

In FIG. 3 the lateral springs are shown in the nondeflected state. In FIG. 4 one of the corner pieces 4 is shown in position in a closed box 6. The lateral springs 5 are now deflected. This deflection urges corner piece 4 toward the diagonally opposite corner piece, as shown in FIG. 1. In the latter Figure, the arrows indicate the direction in which the four corner pieces are urged by the deflected springs 5. In FIGS. 1 and 2 the position of the lid 7 when the box is tightly closed is indicated.

I claim:

1. A package, comprising:

a stack of easily scratchable flexible sheets of light-sensitive material;

a light-tight folder enclosing said stack;

a rigid box open at one end thereof and having a bottom wall, two major frontal walls opposite one another, and two minor intermediate side walls joining said frontal walls, and a lid having an open end fitting over said open end of said box and a top wall covering the open end of the box, said box being so dimensioned as to enclose said stack so tightly that said stack is preventing from buckling;

four corner pieces, each of said corner pieces being constructed of strong material and embracing one of the four small vertical edges of the stack at right angles to the plane of the sheets forming the stack and extending over the corner portions of both large side faces of the stack to form a tight fit thereon, each of said corner pieces being so dimensioned as to permit the side walls of said box to lie tightly against said light-tight folder enclosing said stack of easily scratchable flexible sheets, thereby preventing movement of the sheets in the stack relative to one another; and four spring means, one each engaging one of said four corner pieces at the outside thereof and urging said respective corner piece toward a diagonally opposite corner piece, first and second of said spring means engaging respective first and second of said corner pieces located in two inner corners of said box, each said first and second spring means including a first resilient part resting on said bottom wall of said box and a second resilient part resting on an adjacent said side wall of said box, third and fourth of said spring means engaging respective third and fourth of said corner pieces located in two inner corners of said lid, each of said third and fourth spring means including a first resilient part resting on an adjacent said side wall of said box and a second resilient part resting on said top wall of said lid when said lid is in a fully closed position over said open end of said box, said lid thereby comprising means, when in said fully closed position, for fully tensioning said spring means and for holding said stack in an elastically suspended position in said box.

2. A package as described in claim 1, wherein said spring means are moulded plastic integral springs secured in each corner of the box, including the corners formed when the lid is closed.

3. A package as described in claim 1, wherein said resilient parts of each said spring means associated with a respective said corner piece comprise two springs, one each attached to a side wall of said respective corner piece.

4. A package as described in claim 3, wherein the springs which are attached to each corner piece are leaf springs.

5. A package as described in claim 3, wherein the springs which are attached to each corner piece are coil springs.

6. A package as described in claim 1, wherein said light-tight folder is a light-tight polyethylene bag.

* * * * *